US010511922B2

(12) United States Patent
Jeanne et al.

(10) Patent No.: US 10,511,922 B2
(45) Date of Patent: Dec. 17, 2019

(54) METHOD ADAPTED TO BE IMPLEMENTED IN A MASTER DEVICE OF A SOUND SYSTEM, CORRESPONDING METHOD ADAPTED TO BE IMPLEMENTED IN AN AUDIO RENDERING DEVICE OF A SOUND SYSTEM, CORRESPONDING MASTER DEVICE, AUDIO RENDERING DEVICE, SYSTEM, COMPUTER READABLE PROGRAM PRODUCT AND COMPUTER READABLE STORAGE MEDIA

(71) Applicant: INTERDIGITAL CE PATENT HOLDINGS, Paris (FR)

(72) Inventors: Ludovic Jeanne, Montreuil sur Ille (FR); Jean-Pierre Bertin, Guemene-Penfao (FR); Jean-Marie Steyer, Chateaubourg (FR)

(73) Assignee: INTERDIGITAL CE PATENT HOLDINGS, Paris (FR)

( * ) Notice: Subject to any disclaimer, the term of this patent is extended or adjusted under 35 U.S.C. 154(b) by 0 days.

(21) Appl. No.: 16/087,641

(22) PCT Filed: Mar. 10, 2017

(86) PCT No.: PCT/EP2017/055690

§ 371 (c)(1),
(2) Date: Sep. 22, 2018

(87) PCT Pub. No.: WO2017/162448

PCT Pub. Date: Sep. 28, 2017

(65) Prior Publication Data

US 2019/0110144 A1 Apr. 11, 2019

(30) Foreign Application Priority Data

Mar. 24, 2016 (EP) ..... 16305340

(51) Int. Cl.
*H04R 27/00* (2006.01)
*H04R 3/12* (2006.01)
(Continued)

(52) U.S. Cl.
CPC ..... *H04R 27/00* (2013.01); *H04R 3/12* (2013.01); *H04R 5/02* (2013.01); *H04R 5/04* (2013.01);
(Continued)

(58) Field of Classification Search
CPC . H04R 27/00; H04R 3/12; H04R 5/02; H04R 5/04; H04R 2227/005; H04S 1/00
See application file for complete search history.

(56) References Cited

U.S. PATENT DOCUMENTS 3,795,769 A 3/1974 Nowka et al.
3,952,154 A 4/1976 Gates, Jr.
(Continued)

FOREIGN PATENT DOCUMENTS

EP 2648338 10/2013
GB 2516131 1/2015
(Continued)

*Primary Examiner* — Andrew L Sniezek
(74) *Attorney, Agent, or Firm* — Brian J. Dorini; Patricia A. Verlangieri

(57) ABSTRACT

A method adapted to be implemented in a master device of a distributed sound system is described. The master device includes a plurality of audio input interfaces and is adapted to output audio signals on a set of at least two audio channels. According to an embodiment of the disclosure, the method includes detecting at least one audio signal conveyed by at least one of the audio input interfaces; routing the conveyed signal to at least one of the audio channels, the routing taking into account a number of detected audio signals. A corresponding master device, system, computer readable program product, and computer readable storage medium are also described.

18 Claims, 4 Drawing Sheets

(51) Int. Cl.

| | |
|---|---|
| ***H04R 5/04*** | (2006.01) |
| ***H04R 5/02*** | (2006.01) |
| ***H04S 1/00*** | (2006.01) |

(52) U.S. Cl.

CPC ..... *H04S 1/00* (2013.01); *H04R 2227/005* (2013.01); *H04R 2420/01* (2013.01); *H04R 2420/03* (2013.01); *H04R 2420/07* (2013.01)

(56) References Cited

U.S. PATENT DOCUMENTS

| | | | | |
|---|---|---|---|---|
| 6,052,471 | A | 4/2000 | Van Ryzin | |
| 9,774,966 | B1 * | 9/2017 | Bundy | H04R 27/00 |
| 2004/0021351 | A1 | 2/2004 | House | |
| 2005/0190928 | A1 | 9/2005 | Noto | |
| 2007/0127734 | A1 | 6/2007 | Brulle-Drews | |
| 2009/0060206 | A1 | 3/2009 | Shiba | |
| 2013/0021531 | A1 | 1/2013 | Eguchi et al. | |
| 2016/0315900 | A1 * | 10/2016 | Rowny | H04L 45/24 |

FOREIGN PATENT DOCUMENTS

| | | |
|---|---|---|
| JP | 2000209700 | 7/2000 |
| WO | WO2005076912 | 8/2005 |
| WO | WO2006032205 | 3/2006 |

* cited by examiner

METHOD ADAPTED TO BE IMPLEMENTED IN A MASTER DEVICE OF A SOUND SYSTEM, CORRESPONDING METHOD ADAPTED TO BE IMPLEMENTED IN AN AUDIO RENDERING DEVICE OF A SOUND SYSTEM, CORRESPONDING MASTER DEVICE, AUDIO RENDERING DEVICE, SYSTEM, COMPUTER READABLE PROGRAM PRODUCT AND COMPUTER READABLE STORAGE MEDIA

This application claims the benefit, under 35 U.S.C. § 365 of International Application PCT/EP2017/055690, filed Mar. 10, 2017, which was published in accordance with PCT Article 21(2) on Sep. 28, 2017, in English, and which claims the benefit of European Patent Application No. 16305340.8 filed on Mar. 24, 2016.

1. TECHNICAL FIELD

The present disclosure relates to the field of audio rendering in a distributed system including at least one master device and at least one audio rendering device.

A method adapted to be implemented in a master device of a sound system, corresponding method adapted to be implemented in an audio rendering device of a sound system, corresponding master device, audio rendering device, computer readable program product and computer readable storage media are described.

2. BACKGROUND ART

Communication end-devices, for instance set-top-box (STB), smartphones, tablets, personal computers or peripherals like printers, speakers (or audio renderers), microphone have become widely used nowadays. They can exchange data with other communication devices inside a communication network, for instance a local area network (LAN), thanks to wired communication interfaces (like Ethernet interface) or wireless communication interfaces, like WIFI® or Bluetooth® interfaces. More and more LAN services, notably WLAN services, are deployed in a home environment and used for day-to-day life. The use of wireless devices in a network prevents the need, for a user, from cabling or physically interconnecting devices. However, configuration can still be necessary. Notably, a system (like an audio and/or video system of a home network) comprising several communication devices can have multiple configurations, depending upon the number and the kind of devices present in the system. Notably, a distributed sound system can comprise different configurations, depending upon the number, the kind and the role of the audio renderers present in the system.

Some solutions of the prior art have tried to prevent a user from defining manually the routing of an incoming sound signal to an audio rendering device.

3. SUMMARY

The present principles enable at least one of the above disadvantages of the above solutions to be resolved by proposing a distributed sound system belonging to a communication network.

According to at least one embodiment of the present disclosure, the distributed sound comprises:

at least one master device comprising at least one processor, a plurality of audio input interfaces and a plurality of wireless audio channels, and at least one wireless audio rendering device adapted to consume at least a first and a second of said audio channels.

According to at least one embodiment of the present disclosure, said at least one processor of said master device is configured for:

detecting at least one audio signal conveyed by at least one of said audio input interfaces;

routing said conveyed signal to at least one of said wireless audio channels, said routing taking into account a number of detected audio signals;

alerting said at least one wireless audio rendering device of said sound system when at least a part of said routed audio signal is duplicated on said first and said second of said wireless audio channels; and said at least one wireless audio rendering device comprises at said at least one processor configured for:

receiving an alert about a duplication of said part of said routed audio signal on said first and said second wireless audio channels;

when said first and/or said second wireless audio channel are both consumed by said audio rendering device, consuming a single channel amongst said first and/or said second channel.

According to at least one embodiment of the present disclosure, the distributed sound comprises:

at least one master device comprising at least one processor, a plurality of audio input interfaces and a plurality of wireless audio channels, and at least one wireless audio rendering device adapted to consume at least a first and a second of said audio channels.

According to at least one embodiment of the present disclosure, said at least one processor of said master device is configured for:

detecting at least one audio signal conveyed by at least one of said audio input interfaces;

routing said conveyed signal to at least one of said wireless audio channels, said routing taking into account a number of detected audio signals;

alerting said at least one wireless audio rendering device of said sound system when at least a part of said routed audio signal is duplicated on said first and said second of said wireless audio channels; and said at least one wireless audio rendering device comprises at said at least one processor configured for:

receiving an alert when said part of said routed audio signal is duplicated on said first and said second wireless audio channels;

upon receiving said alert, consuming a single channel amongst said first and/or said second wireless audio channel.

According to at least one embodiment of the present disclosure, said single channel is selected according to a selection rule taking into account a numbering of said first and/or second audio channel.

According to at least one embodiment of the present disclosure, said distributed sound system comprises at least two audio rendering devices and said single channel is selected according to a selection rule common to at least two of said audio rendering devices.

According to at least one embodiment, the distributed sound system comprises:

at least one master device comprising at least one processor and a plurality of audio input interfaces, said master device being adapted to output audio signals on a set of at least two audio channels, and at least one audio rendering device adapted to consume at least one of said audio channels, According to at least one embodiment of the distributed sound system of the present disclosure, said at least one processor can be configured for:

detecting at least one audio signal conveyed by at least one of said audio input interfaces;

routing said conveyed signal to at least one of said audio channels, said routing taking into account a number of detected audio signals.

According to at least one embodiment of the present disclosure, said master device can comprise at least one memory and at least one processing circuitry configured to perform:

detecting at least one audio signal conveyed by at least one of said audio input interfaces;

routing said conveyed signal to at least one of said audio channels, said routing taking into account a number of detected audio signals.

According to at least one embodiment of the present disclosure, said master device can comprise at least one wireless interface adapted to output at least one of said audio channels and said at least one processor can be configured for alerting at least one of the audio rendering devices about a duplication of a routed audio signal on a plurality of said audio channels.

According to another aspect, the present disclosure relates to a method adapted to be implemented in a master device of a distributed sound system.

According to at least one embodiment of the present disclosure, said method is adapted to be implemented in a master device of a distributed sound system, said master device comprising a plurality of audio input interfaces and a plurality of wireless audio channels.

According to at least one embodiment of the present disclosure, said method comprises:

detecting at least one audio signal conveyed by at least one of said audio input interfaces;

routing said conveyed signal to at least one of said wireless audio channels, said routing taking into account a number of detected audio signal;

alerting at least one wireless audio rendering device of said sound system when at least a part of said routed audio signal is duplicated on at least a first and a second of said wireless audio channels.

According to at least one embodiment of the present disclosure, the method comprises alerting at least one wireless audio rendering device of said sound system when different audio signals are routed on said first and said second audio channels.

According to at least one embodiment of the present disclosure, said master device comprises a plurality of audio input interfaces, said master device being adapted to output audio signals on a set of at least two audio channels.

According to at least one embodiment of the present disclosure, said method can comprise:

detecting at least one audio signal conveyed by at least one of said audio input interfaces;

routing said conveyed signal to at least one of said audio channels, said routing taking into account a number of detected audio signals.

According to at least one embodiment of the present disclosure, when a unique audio signal is detected, said detected signal can be routed to each of said audio channels.

According to at least one embodiment of the present disclosure, when different audio signals are detected, each different signal can be routed to a sub-set of said set of audio channels, said sub-sets constituting a partitioning of said set of audio channels.

According to at least one embodiment of the present disclosure, said audio input interfaces can comprise at least one analog input interface.

According to at least one embodiment of the present disclosure, said detecting can be performed thanks to an integrated energy detector.

According to at least one embodiment of the present disclosure, said audio input interfaces can comprise at least one digital input interface.

According to at least one embodiment of the present disclosure, said detecting can comprise detecting a changing state of a signal received on said digital input interface.

According to at least one embodiment of the present disclosure, wherein said master device can comprise at least one wireless interface adapted to output at least one of said audio channels, said method can comprise alerting at least one audio rendering device of said sound system about a duplication of a routed audio signal on a plurality of said audio channels.

According to another aspect, the present disclosure relates to a master device adapted to be arranged in a distributed sound system belonging to a communication network, said master device comprising at least one processor, a plurality of audio input interfaces and a plurality of wireless audio channels.

According to at least one embodiment of the present disclosure, said at least one processor is configured for:

detecting at least one audio signal conveyed by at least one of said audio input interfaces;

routing said conveyed signal to at least one of said wireless audio channels, said routing taking into account a number of detected audio signals;

alerting at least one wireless audio rendering device of said sound system when at least a part of said routed audio signal is duplicated on at least a first and a second of said wireless audio channels.

According to at least one embodiment of the present disclosure, said at least one processor is configured for sending said part of said incoming signal conditionally on said first and/or said second channel.

According to at least one embodiment of the present disclosure, said at least one processor is configured for receiving a selection of an audio channel, amongst said first and/or second audio channel, to be consumed by said audio rendering device.

According to at least one embodiment of the present disclosure, said at least one processor is configured for sending said part of said incoming signal conditionally on said first and/or said second channel according to said receiving.

According to at least one embodiment of the present disclosure, said alerting is sent on a Data Side Channel integrated in the wireless path between said master device and said audio rendering device.

According to at least one embodiment of the present disclosure, said alerting is performed periodically.

According to at least one embodiment of the present disclosure, said alerting is performed when the number of incoming signal is changed.

According to at least one embodiment of the present disclosure, said alerting is performed conditionally according to a period of time elapsed since the last pairing of the master device with a wireless audio rendering device.

According to at least one embodiment of the present disclosure, said processor is configured for alerting at least one wireless audio rendering device of said sound system about a routing of different audio signals on said first and second audio channels.

According to at least one embodiment of the present disclosure, said master device is adapted to output audio signals on a set of at least two audio channels.

According to at least one embodiment of the present disclosure, said at least one processor can be configured for:

detecting at least one audio signal conveyed by at least one of said audio input interfaces;

routing said conveyed signal to at least one of said audio channels, said routing taking into account a number of detected audio signals.

According to another aspect, the present disclosure relates to a master device adapted to be comprised in a distributed sound system belonging to a communication network, said master device comprising at least one processor and a plurality of audio input interfaces, said master device being adapted to output audio signals on a set of at least two audio channels.

According to at least one embodiment of the present disclosure, said master device can comprise at least one memory and at least one processing circuitry configured to perform:

detecting at least one audio signal conveyed by at least one of said audio input interfaces;

routing said conveyed signal to at least one of said audio channels, said routing taking into account a number of detected audio signals.

According to at least one embodiment of the present disclosure, said at least one processor and/or said at least one processing circuitry can be configured for routing, when a unique audio signal is detected, said detected signal to each of said audio channels.

According to at least one embodiment of the present disclosure, said at least one processor and/or said at least one processing circuitry can be configured for routing, when different audio signals are detected, each different signal to a sub-set of said set of audio channels, said sub-sets constituting a partitioning of said set of audio channels.

While not explicitly described, a master device of the present disclosure can be adapted to perform the corresponding method of the present disclosure in any of its embodiments.

According to another aspect, the present disclosure relates to a method, adapted to be implemented in a wireless audio rendering device of a distributed sound system belonging to a communication network and comprising a master device, said audio rendering device being adapted to consume audio signals on a first and a second wireless audio channels.

According to at least one embodiment of the present disclosure, said method comprises:

receiving an alert when said part of said routed audio signal is duplicated on said first and said second wireless audio channels;

upon receiving said alert, consuming a single channel amongst said first and/or said second wireless audio channel.

According to at least one embodiment of the present disclosure, said method comprises:

receiving an alert about a duplication of at least a routed audio signal on said first and said second wireless audio channels;

selecting at least one audio channel to be consumed amongst said first and/or said second wireless audio channel according to said alerting.

According to at least one embodiment of the present disclosure, said method comprises informing said master device about said selecting.

According to at least one embodiment of the present disclosure, said alert is received on a Data Side Channel integrated in the wireless path between said master device and said audio rendering device.

According to at least one embodiment of the present disclosure, said alert is received periodically.

According to another aspect, the present disclosure relates to a wireless audio rendering device of a distributed sound system belonging to a communication network and comprising a master device, said audio rendering device being adapted to consume audio signals on at least a first and a second wireless audio channels.

According to at least one embodiment of the present disclosure, said audio rendering device comprises at least one processor configured for:

receiving an alert when said part of said routed audio signal is duplicated on said first and said second wireless audio channels;

upon receiving said alert, consuming a single channel amongst said first and/or said second wireless audio channel.

According to at least one embodiment of the present disclosure, said audio rendering device comprises at least one processor configured for:

receiving an alert about a duplication of at least a routed audio signal on said first and said second wireless audio channels;

selecting at least one audio channel to be consumed amongst said first and/or said second wireless audio channels according to said alerting.

According to at least one embodiment of the present disclosure, said at least one processor is configured for informing said master device about said selecting.

According to at least one embodiment of the present disclosure, said alert is received on a Data Side Channel integrated in the wireless path between said master device and said audio rendering device.

According to at least one embodiment of the present disclosure, said alert is received periodically.

While not explicitly described, the audio rendering device of the present disclosure can be adapted to perform the corresponding method of the present disclosure in any of its embodiments.

While not explicitly described, the distributed sound system of the present disclosure can be adapted to perform at least one of the methods of the present disclosure in any of its embodiments.

Notably, while not explicitly described, the master device of the distributed sound system of the present disclosure can be adapted to perform the corresponding method of the present disclosure in any of its embodiments.

Also, while not explicitly described, the audio rendering device of the distributed sound system of the present disclosure can be adapted to perform the corresponding method of the present disclosure in any of its embodiments.

While not explicitly described, the present embodiments related to a method or to the corresponding device or system can be employed in any combination or sub-combination.

For example, some embodiments can be related to a method, adapted to be implemented in a master device of a distributed sound system, said master device comprising a plurality of audio input interfaces, notably at least one analog input interface and at least one digital input interface, said master device being adapted to output audio signals on a set of at least two audio channels, and said method comprising:

detecting at least one audio signal conveyed by at least one of said audio input interfaces;

routing said conveyed signal to at least one of said audio channels, said routing taking into account a number of detected audio signals;

and, when different audio signals are detected, each different signal is routed to a sub-set of said set of audio channels, said sub-sets constituting a partitioning of said set of audio channels.

According to another aspect, the present disclosure relates to a non-transitory program storage product, readable by a computer.

According to at least one embodiment of the present disclosure, said non-transitory computer readable program product tangibly embodies a program of instructions executable by a computer to perform at least one of the methods of the present disclosure in any of its embodiments.

According to at least one embodiment of the present disclosure, said non-transitory computer readable program product can tangibly embody a program of instructions executable by a computer for performing, when said non-transitory software program is executed by a computer, a method adapted to be implemented in a master device of a distributed sound system, said master device comprising a plurality of audio input interfaces, said master device being adapted to output audio signals on a set of at least two audio channels, said method comprising:

detecting at least one audio signal conveyed by at least one of said audio input interfaces;

routing said conveyed signal to at least one of said audio channels, said routing taking into account a number of detected audio signals.

According to at least one embodiment of the present disclosure, said non-transitory computer readable program product tangibly embodies a program of instructions executable by a computer for performing, when said non-transitory software program is executed by a computer, a method adapted to be implemented in a master device of a distributed sound system, said master device comprising a plurality of audio input interfaces and a plurality of wireless audio channels, said method comprising:

detecting at least one audio signal conveyed by at least one of said audio input interfaces;

routing said conveyed signal to at least one of said wireless audio channels, said routing taking into account a number of detected audio signals;

alerting at least one wireless audio rendering device of said sound system when at least a part of said routed audio signal is duplicated on at least a first and a second of said wireless audio channels.

According to at least one embodiment of the present disclosure, the non-transitory computer readable program product tangibly embodies a program of instructions executable by a computer for performing, when said non-transitory software program is executed by a computer, a method adapted to be implemented in a wireless audio rendering device of a distributed sound system belonging to a communication network and comprising a master device, said audio rendering device being adapted to consume audio signals on a first and a second wireless audio channels, wherein said audio rendering device comprises at least one processor configured for:

receiving an alert about a duplication of at least a routed audio signal on said first and said second wireless audio channels;

selecting at least one audio channel to be consumed amongst said first and/or said second wireless audio channel according to said alerting.

According to another aspect, the present disclosure relates to a computer readable storage medium carrying a software program comprising program code instructions for performing at least one of the methods of the present disclosure, in any of its embodiments, when said non transitory software program is executed by a computer.

According to at least one embodiment of the present disclosure, said computer readable storage medium can tangibly embody a program of instructions executable by a computer for performing, when said non-transitory software program is executed by a computer, a method adapted to be implemented in a master device of a distributed sound system, said master device comprising a plurality of audio input interfaces, said master device being adapted to output audio signals on a set of at least two audio channels, said method comprising:

detecting at least one audio signal conveyed by at least one of said audio input interfaces;

routing said conveyed signal to at least one of said audio channels, said routing taking into account a number of detected audio signals.

According to at least one embodiment of the present disclosure, said computer readable storage medium tangibly embodies a program of instructions executable by a computer for performing, when said non-transitory software program is executed by a computer, a method adapted to be implemented in a master device of a distributed sound system, said master device comprising a plurality of audio input interfaces and a plurality of wireless audio channels, said method comprising:

detecting at least one audio signal conveyed by at least one of said audio input interfaces;

routing said conveyed signal to at least one of said wireless audio channels, said routing taking into account a number of detected audio signals;

alerting at least one wireless audio rendering device of said sound system when at least a part of said routed audio signal is duplicated on at least a first and a second of said wireless audio channels.

According to at least one embodiment of the present disclosure, the computer readable storage medium tangibly embodies a program of instructions executable by a computer for performing, when said non-transitory software program is executed by a computer, a method adapted to be implemented in a wireless audio rendering device of a distributed sound system belonging to a communication network and comprising a master device, said audio rendering device being adapted to consume audio signals on a first and a second wireless audio channels, said method comprising:

receiving an alert when said part of said routed audio signal is duplicated on said first and said second wireless audio channels;

upon receiving said alert, consuming a single channel amongst said first and/or said second wireless audio channel.

According to at least one embodiment of the present disclosure, the computer readable storage medium tangibly embodies a program of instructions executable by a computer for performing, when said non-transitory software program is executed by a computer, a method adapted to be implemented in a wireless audio rendering device of a distributed sound system belonging to a communication network and comprising a master device, said audio rendering device being adapted to consume audio signals on a first and a second wireless audio channels, said method comprising:

receiving an alert about a duplication of at least a routed audio signal on said first and said second wireless audio channels;

selecting at least one audio channel to be consumed amongst said first and/or said second wireless audio channel according to said alerting.

4. LIST OF DRAWINGS

The present disclosure can be better understood, and other specific features and advantages can emerge upon reading the following description, the description making reference to the annexed drawings wherein.

It is to be noted that the drawings have only an illustration purpose and that the embodiments of the present disclosure are not limited to the illustrated embodiments.

5. DETAILED DESCRIPTION OF THE EMBODIMENTS

At least one embodiment of the present disclosure offers a new way of setting up an audio routing configuration of a master device of a sound system belonging to a communication network (like a local area network). The master device can be for instance a STB, a TV, a tablet, a smartphone, a PC, and/or a specific peripheral device, also called hereinafter a "dongle", mounted on one of those devices.

Indeed, at least some embodiments of the present disclosure can allow to have an at least partially automatic routing, by the master device, of at least one incoming audio signal, while reducing the complexity and/or the hardware manufacturing cost of the audio rendering device.

More precisely, at least one embodiment of the present disclosure proposes a configuration process of a master device that can take into account the number of received incoming signals for dispatching an output audio signal on a set of output audio channels.

At least one embodiment of the present disclosure can thus permit to suppress, or at least limit, the need of dedicated user switches (like mechanical switches) on the speakers, of an implementation of a costly user interface on the master device, and/or of an implementation of a complicated method in a firmware of a master device.

At least one embodiment of the present disclosure can permit a dynamic configuration of the sound system, that follows the network changes (typically when an audio source is connected or not to the sound system).

Notably, in at least one embodiment of the present disclosure, a change of the audio configuration of the sound system (like the addition of an audio source) can be performed without a reboot of the dongle and/or the audio rendering devices.

At least some embodiments of the present disclosure can be adapted to a configuration of a wireless system comprising a variable number of devices.

Figure 1:
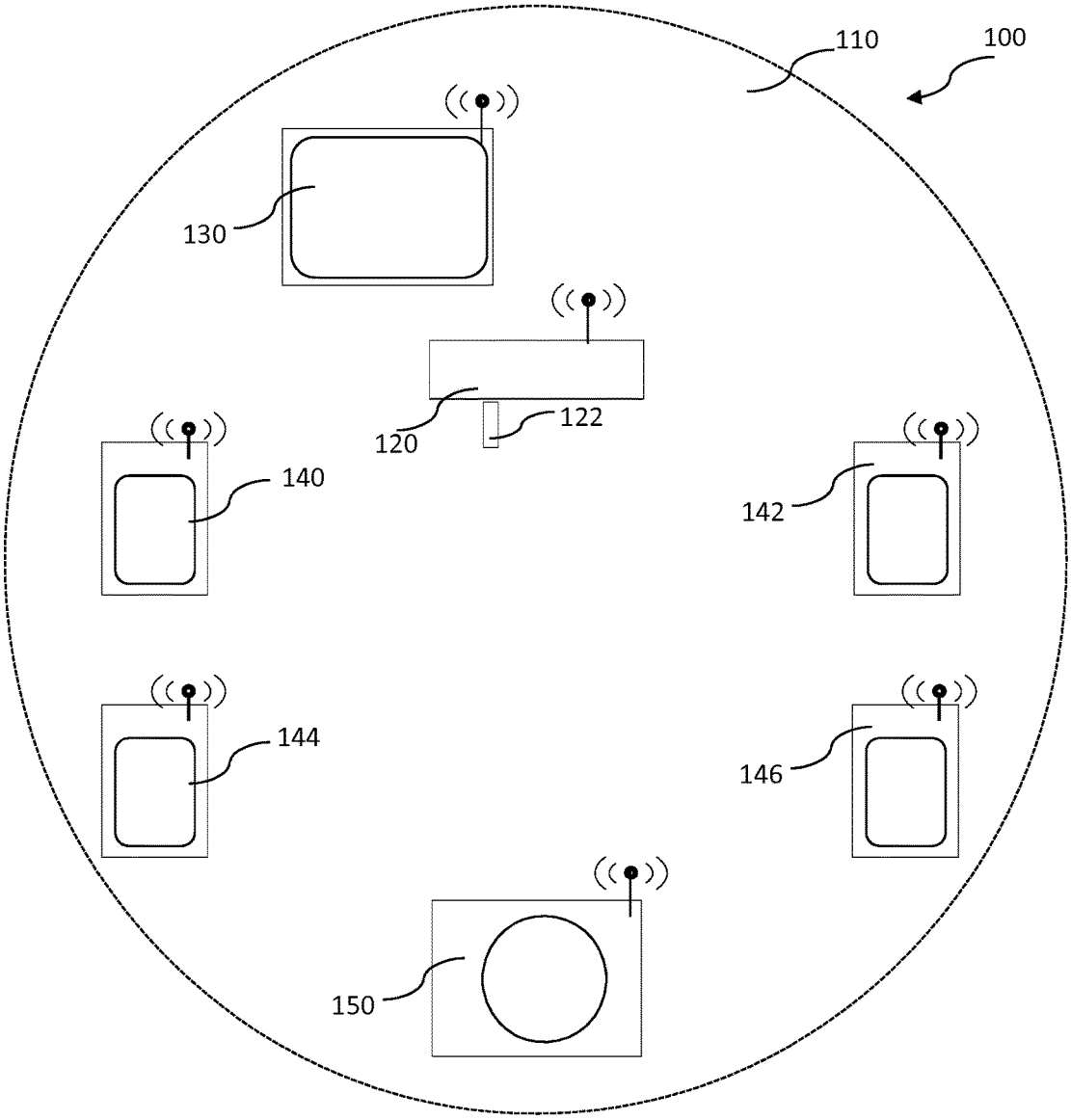
FIG. 1 shows an example of a sound system belonging to a wireless communication network according to a particular embodiment of the present disclosure.

In the detailed embodiment illustrated in FIG. 1, a sound system 100 is described. The sound system comprises audio processing capabilities. Optionally, it can further comprise video processing capabilities.

The sound system 100 belongs to a communication network 110, for instance, as illustrated, a wireless communication network. The system 100 is a distributed sound system (for instance a surround sound system) that notably includes a master device 120, acting as a routing device, adapted to output at least an audio signal. Depending upon embodiments, the master device can be a Set Top Box, a tablet, a PC, a smartphone, a Blue-ray player, a TV, a specific dongle that equips another device (like a STB), or any kind of wireless device that can output audio channels. In the illustrated embodiment, the system 100 comprises a Set Top Box (STB) 120 which can receive an audiovisual signal (for instance from another communication network, like an internet network) and can output a video component of the audiovisual signal (that can be rendered by a display 130 for instance) and at least one audio component of the audiovisual signal (that can be rendered by an audio renderer 140, 142, 144, 146, 150 of the system 100 for instance). In the particular embodiment of FIG. 1, the STB 120 is equipped with a peripheral device 122, for instance a dongle connected to one of the USB port of the STB, for powering purpose notably. The dongle 12 comprises wired audio input interfaces, that can receive audio signals coming from the STB, and wired and/or wireless transmitting interfaces adapted for output audio signal on audio channels. In other embodiments, the dongle can comprise wireless input interfaces, adapting for receiving audio signals.

The system 100 also include audio renderers 140, 142, 144, 146, 150, acting as slave devices of the master device 122. In the illustrated embodiment, the audio renderers are either satellite loudspeakers 140, 142, 144, 146 or a subwoofer 150. A subwoofer is a specialized audio renderer, in charge of the rendering of the low frequency part of an audio signal thanks to a low pass filter.

In some other embodiment, other types of audio rendering devices (like a medium speaker or a tweeter speaker) can be present in the sound system. For instance, the sound system can comprise audio rendering devices working in different frequency ranges like a medium speaker (working for instance in frequencies between 100 to 4000 Hz), a tweeter speaker (working for instance in frequencies above 4000 Hz), and/or a satellite speaker (comprising a combination of at least one medium speaker and at least one tweeter speaker).

In the illustrated embodiment, the master device 122 can transmit at least one audio signal to at least one audio renderer 140, 142, 144, 146, 150 of the sound system 100.

In the embodiment illustrated, all the audio rendering devices are wireless devices. Of course, in other embodiments of the present disclosure, the system can include wired audio rendering devices, like devices connected via an Ethernet connection. Other types of wired connections can be used, if they are adapted to permit the respect of audio synchronization constraints between the wireless and wired part of the distributed sound system. For instance, the subwoofer can be connected by an Ethernet wired connection to the STB.

Depending upon embodiments, the renderers can have different or similar acoustic characteristics and/or same or different firmware. Notably, in some embodiments, the system can comprise a heterogeneous set of satellite speakers, with different firmware, or different kinds of speakers.

Figure 3:
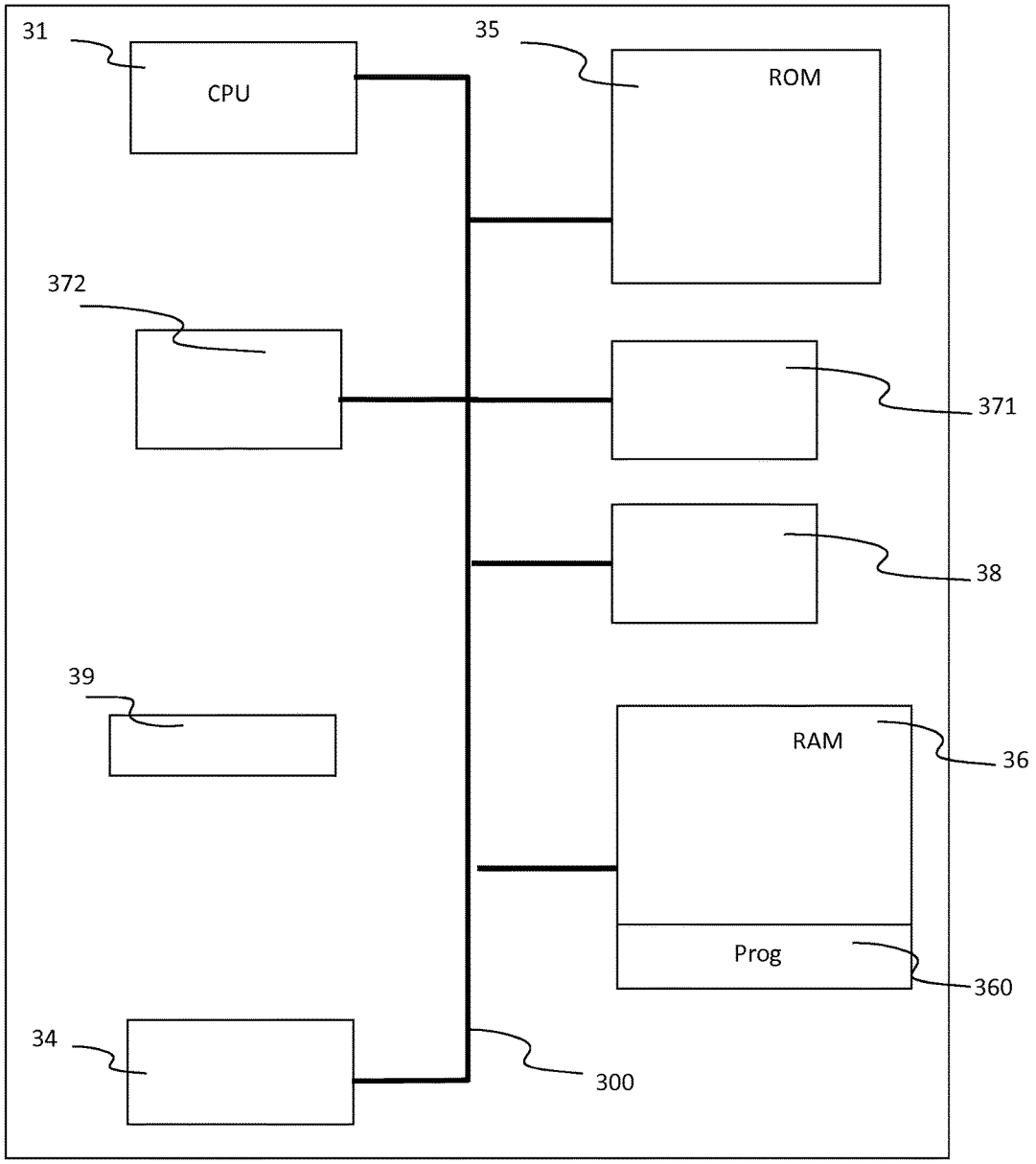
FIG. 3 illustrates an exemplary structure of the master device of the sound system of FIG. 1.

FIG. 3 describes a master device, like the dongle 122 mounted on the STB 120 illustrated by FIG. 1.

In the particular embodiment of FIG. 3, the master device can include different devices, linked together via an USB protocol or via a data and address bus 300 which can also carry a timer signal. For instance, it can include a microprocessor 31 (or CPU), at least one Input/Output module 34, (like a led for instance, being indicative of the powering on of the dongle), a ROM (or «Read Only Memory») 35, a RAM (or «Random Access Memory») 36, communication interfaces 38 configured for the reception and/or transmission of data via a wireless connection, wired communication interfaces 371, 372 for the reception of audio signals, a power supply interface 39 (like an USB port for instance). The master device can also comprise other wireless connections, like WIFI or Bluetooth® connections (optional).

Each of the mentioned memories can include at least one register, that is to say a memory zone of low capacity (a few binary data) or high capacity (with a capability of storage of a whole program or of all or part of data representative of data to be calculated or displayed).

According to a variant, the master device includes several microprocessors.

In the illustrated embodiment, the device is powered by an external power supply source (the power supply source of the STB 120) through an USB port. According to another variant, the power supply source can be internal to the master device.

In the illustrated embodiment, the master device comprises a plurality wired input interfaces. The wired input interfaces of the dongle 122 can comprise an optical interface 371 that can receive a digital signal through an optical fiber cable. The wired input interfaces of the dongle 122 can further comprise a digital interface 372 (like a coaxial interface or an interface integrated in a JACK interface, notably a 4 poles JACK interface), that can receive a digital incoming signal. The wired input interfaces can also comprise at least one analog incoming input (integrated for instance in a JACK interface, notably a 4 poles JACK interface), being a mono audio analog signal or a component of a stereo audio analog signal.

The digital signal conveyed through the optical 371 and/or the coaxial 372 interfaces can have a format compatible with a communication standard, and notably with a version of the International Electro technical Commission (IEC) standard IEC 60958, like the Sony®/Philips® Digital Interface Format (S/PDIF).

Depending upon embodiments, the number of incoming audio signals can vary: in some embodiments, the device can receive a single stereo audio signal on one of the digital audio inputs, or on the two inputs of the analog interface. In other embodiments, the device can receive several audio signals. For instance, in the illustrated embodiment where only one of the two digital inputs can enabled at a moment, the device can receive at the same time a digital signal (on one of the two digital inputs) and an analog signal.

The device further comprises a plurality of audio output interfaces, being wired interface (like Ethernet cable) and/or wireless interface or a combination thereof, for conveying output audio channels. In the illustrated embodiment, the device can output up to 4 channels on wireless interfaces 38.

When the master device is powered on, the microprocessor 31 loads program instructions 360 in a register of the RAM 36, notably the processes needed for performing at least one embodiment of the method implemented in a master device described herein, and executes the program instructions.

In the particular embodiment illustrated in FIG. 3, the microprocessor 31 can be configured for:

- detecting at least one audio signal conveyed by at least one of the audio input interfaces;
- routing the conveyed signal to at least one of the audio channels, said routing taking into account a number of detected audio signals.

In some embodiments, the microprocessor 31 can be configured for:

- detecting at least one audio signal conveyed by at least one of the audio input interfaces;
- routing the conveyed signal to at least one of the wireless audio channels, the routing taking into account a number of detected audio signals;
- alerting at least one wireless audio rendering device of the sound system when at least a part of the routed audio signal is duplicated on at least a first and a second of the wireless audio channels.

Figure 4:
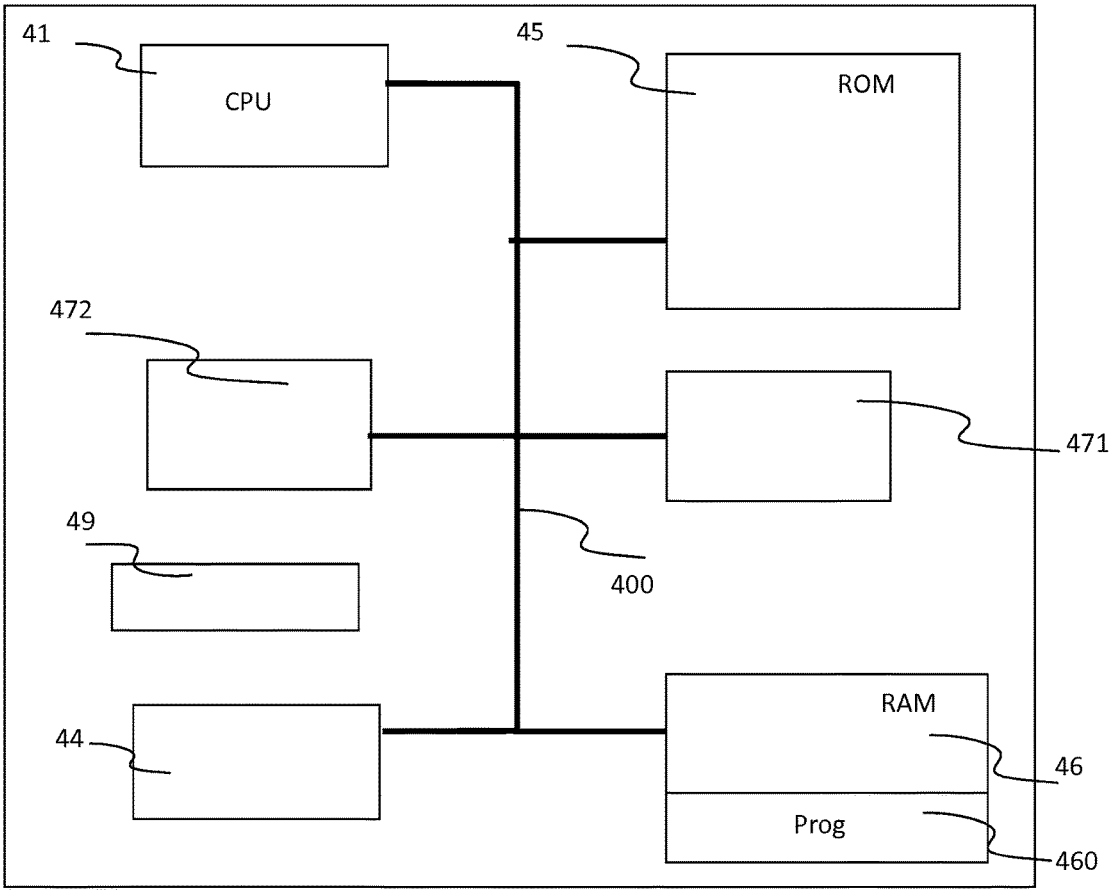
FIG. 4 illustrates an exemplary structure of an audio rendering device of the sound system of FIG. 1.

FIG. 4 describes an audio rendering device, as one of the speakers illustrated by FIG. 1.

In the particular embodiment of FIG. 4, the audio rendering device can include different devices, linked together via an USB protocol or via a data and address bus 400 which can also carry a timer signal. For instance, it can include a micro-processor 41 (or CPU), at least one Input/Output module 44, (like a led for instance, being indicative of the powering on of the audio rendering device), a ROM (or «Read Only Memory») 45, a RAM (or «Random Access Memory») 46, communication interfaces 471, 472 configured for the reception and/or transmission of data via a wireless connection, notably wireless communication interfaces for the reception of audio signals, a power supply interface 49 allowing powering of the audio rendering device via a power source, like the Main. The audio rendering device can also comprise other wireless connections, like WIFI or Bluetooth® connections (optional).

Each of the mentioned memories can include at least one register, that is to say a memory zone of low capacity (a few binary data) or high capacity (with a capability of storage of a whole program or of all or part of data representative of data to be calculated or displayed).

According to a variant, the audio rendering device includes several microprocessors.

Depending upon embodiments, the number of audio channels consumed by the audio rendering devices can vary.

When the audio rendering device is powered on, the microprocessor 41 loads program instructions 460 in a register of the RAM 46, notably the processes needed for performing at least one embodiment of the method implemented in an audio rendering device described herein, and executes the program instructions.

In the particular embodiment illustrated in FIG. 4, where the audio rendering device is adapted to consume audio signals on at least a first and a second wireless audio channels, the microprocessor 41 can be configured for:

- receiving an alert about a duplication of at least a routed audio signal on the first and the second wireless audio channels;

selecting at least one audio channel to be consumed amongst the first and/or the second wireless audio channels according to the alerting.

Depending upon embodiments, different configurations of the system 100 are possible. Indeed, the number and/or the kind of speakers present in the system can vary. For instance, the system can comprise several satellite speakers and a subwoofer, dedicated to bass rendering. The presence of such a subwoofer is optional.

Furthermore, the role of a speaker can vary upon the time: it can either be used to render a main audio signal or an ancillary audio signal, distinct for the main audio signal.

In the illustrated embodiment, the master device 122 can output up to 4 audio channels. More precisely, the master device 122 can automatically route up to 2 stereo inputs, to 1 or 2 stereos (or pair of mono) speakers. Of course, in other embodiments, the master device can receive and output more than two audio signals at the same time.

In a first configuration, the system 100 can for instance comprise a pair of main speakers (each being in charge of rendering a mono channel), like a Left speaker and a Right speaker, and an ancillary audio renderer being a subwoofer (consuming two audio channels), all located in a same room.

In a second configuration, the system can for instance comprise the rendering devices of the first configuration plus a stereo ancillary speaker (or a pair of ancillary mono speakers) located in the same room than the other audio rendering devices of the first configuration.

In a third configuration, the system can for instance comprise the rendering devices of the first configuration plus a stereo ancillary speaker (or a pair of ancillary mono speakers) located in the different room than the other audio rendering devices of the first configuration.

Depending upon embodiments, the speakers located in a different room can render the same audio signal as the speaker of the first configuration or a different audio signal.

According to the present disclosure, the device adapts automatically (or at least partially automatically) its audio routing to the number of incoming signals. The routing decision is performed by the microcontroller 31 of the device according to the incoming signals currently present.

Thus, at least some embodiments of the present disclosure can permit a user to modify dynamically the audio configuration of the system, without any action through a user interface of the master device.

Depending upon embodiments where several incoming signals are received, the source of the incoming signals can be unique or can differ. In the illustrated embodiment, the dongle 122 can be directly connected to up to two stereo audio sources, coming from a same device or from different devices. At least one source of the audio signal(s) incoming to the dongle 122 can be an external device (like a smart phone temporary connected to the dongle by a coaxial cable), or the STB itself. Notably, in some embodiments, the STB has the capability to output two different stereo audio channels (like a TV audio channel and an audio channel outputting a signal received from a radio station). In such an embodiment, the STB can comprise a user interface enabling a user to modify the routing of the audio signals incoming to the dongle and thus to the audio channels without any physical action on the dongle or the audio renderer themselves.

Such a user interface can permit a user of the STB to select between:

a configuration with a subwoofer, or an ancillary pair of speakers located in the same room as the main speakers;

a configuration in a multi-room mode where a speaker is located in another room and render the same audio signal as the main speaker;

a configuration in a multi-room mode where a speaker is located in another room and render a different audio signal than the main speaker.

The two first configurations lead to a unique audio signal being received by the dongle. The latest configurations lead to two different audio signals being received by the dongle. As the dongle can route incoming signals to adequate audio channels according to the number of incoming signals, the choice of the user can be taken into account without any direct action of the user on the dongle and the audio rendering devices (except eventually moving a speaker to its right location). Thus, by avoiding the need of software and/or hardware user control component for the master device and the renderers, at least some embodiment of the present disclosure can permit to offer a cheaper and friendlier user interface to a user of STB.

In the illustrated embodiment, the audio channels are partitioned into main channels (dedicated to the output of a main signal, for instance the signal linked to the video signal of the STB), and ancillary channels, which role can differ upon embodiments.

In the system 100, the audio renderers present at a given moment in the system can vary. For instance, a renderer can be either on or off. An audio renderer can also be added or removed from the system by a user. However, the presence, or absence, of a speaker can have an incidence on the consumption of an output audio channel (and thus on the effective transmission of audio signal on output channels) but may have no effect on the routing of incoming audio signals to the audio channels themselves.

Figure 2:
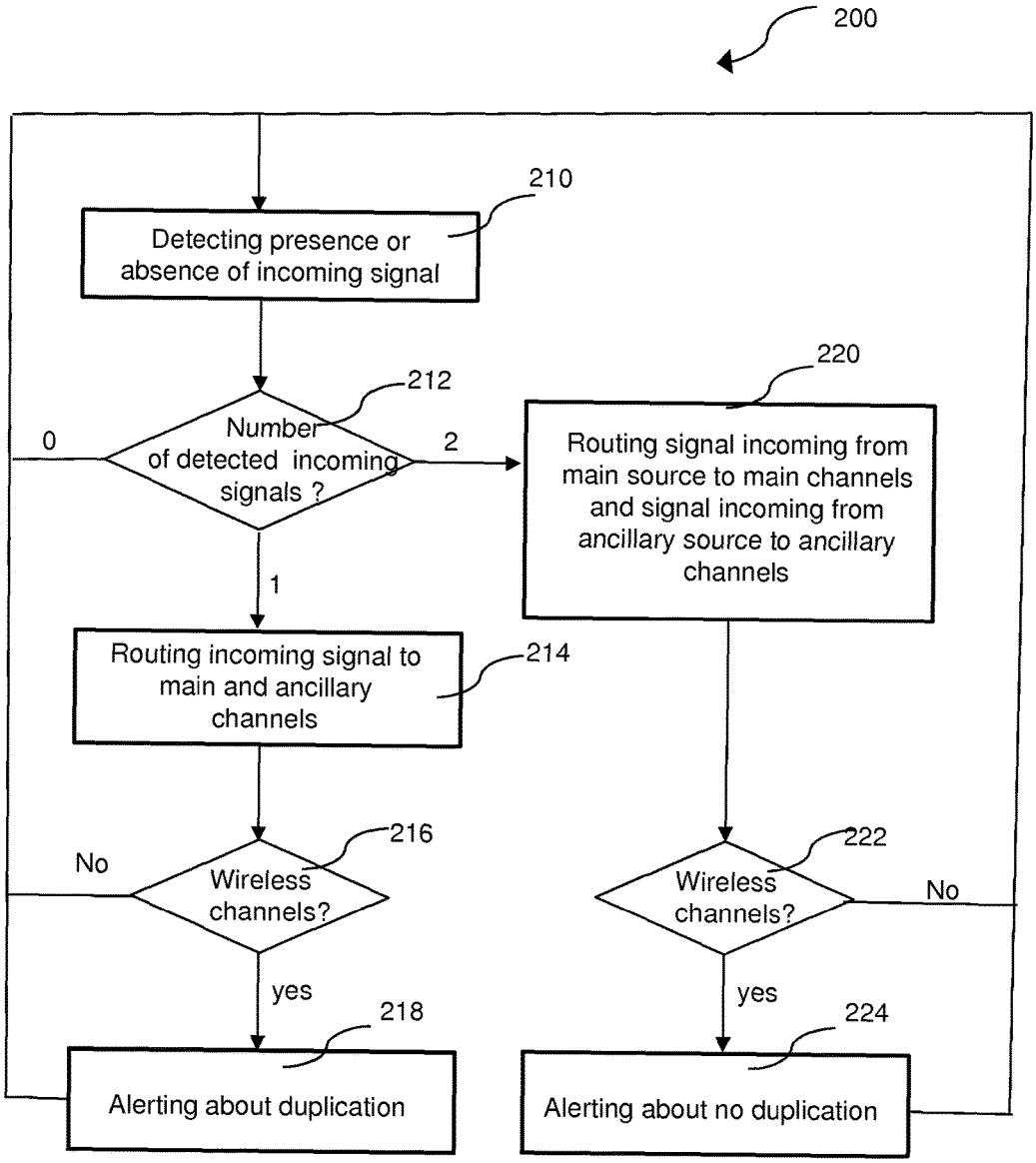
FIG. 2 illustrates an embodiment of the method of the present disclosure implemented in a master device of the sound system of FIG. 1.

FIG. 2 shows a particular embodiment of the method 200 of the present disclosure, implemented in a master device. For instance, the master device can be a STB, or a specific dongle 122 connected to a legacy STB 120 and embedding a microcontroller implementing the method of the present disclosure, as illustrated by FIG. 1.

According to the embodiment illustrated, the method 200 is implemented in the dongle device 122 illustrated by FIG. 3. When the dongle is powered on, no incoming signal has still be detected, and no output is performed on the audio channels of the dongle.

The method can then comprise detecting 210 a presence of an incoming audio signal on one of the input interfaces of the device. The detecting 210 can comprise detecting that at least one digital input is a valid audio signal. Indeed, in the particular embodiment described, each digital input interface is connected on an input interface of the microcontroller 31 of the dongle 122. When no audio incoming audio signal is produced by an audio source on the digital input interface, the value input to the microcontroller 31 stays constant, or almost constant. A changing state of the value of the digital input can thus indicate the reception of an incoming signal, different from noise signal, to the microcontroller.

In the illustrated embodiment, the dongle comprises only one digital signal receptor, in charge of processing a digital incoming signal. Thus, the two digital inputs cannot be used simultaneously. One of the digital input can thus be selected as the active one, per default, after the powering on of the dongle or in absence of any audio signal on both digital inputs. The default active input can be for instance the optical input. The method can comprise, when no valid signal is detected on the active input, periodically analyzing the other digital input, in order to detect a changing state on the other digital input.

The detecting can comprise an optional checking related to the incoming signal, in order to assure that the incoming signal is a signal that can be processed by the dongle. For instance, if the receptor module of the dongle has no decoding capability, the checking can comprise checking that the incoming audio signal is not a compressed signal (like a Pulse Code Modulation (PCM) signal). In some embodiments, an incoming signal can be considered as a valid signal only if it can be processed by the dongle.

The detecting of an incoming analog signal can be performed for instance by an energy detector module, integrated in the master device 122.

In the embodiment illustrated, a digital signal that can be received by one of the digital input is considered as the "main" incoming signal and an analog signal that can be received by one of the digital input is considered as an "ancillary" signal.

According to the present disclosure, the method further comprise testing 212 the number of audio signals currently incomed to the dongle. Depending upon embodiments, the testing can be performed periodically or each time a new incoming signal is detected.

When a unique incoming signal is detected, the method can comprise routing 214 the incoming signal (being either a main signal or an ancillary signal) to all the audio channels (the main channels and the ancillary channels) of the device 122.

When two incoming signals are detected, the method can comprise routing 220 the digital incoming signal (considered herein as the main incoming signal) to the main channels and the analog incoming signal (considered herein as the ancillary incoming signal) to the ancillary channels of the device 122.

In some embodiments, the method can comprise detecting 210 an absence of incoming signal in a digital and/or analog input. For a digital input, the absence of incoming signal can for instance be assumed in case of low or lack of variation of the value of the digital input. For an analog input, the absence of incoming signal can be detected by the integrated energy detector. In such a case, the method can also comprise a new routing of the incoming signals (similarly to what have already been described).

As explained above, it can happen that a same audio signal is output on at least two audio channels. It can be the case for instance when only one audio signal is input to a master device that comprises wireless interfaces for the output of audio signal on four audio channels. When a same audio signal is routed on at least two audio channels, the master device can either transmit the audio signal on several channels, if some audio speakers are listening to those audio channels, or only transmit the signal on one of the at least two audio channels, if all speakers are consuming the same audio channels. Indeed, the master device can comprise a wireless transmitter adapted to transmit audio signal only on the audio channels that are consumed by at least one device.

In embodiments where the master device output at least some of the audio channels thanks to wireless interfaces 216, 222, the method can comprise alerting 218 at least one of the audio rendering devices about the duplication of the audio signal on at least two of audio channels.

Indeed, when a speaker can dynamically select the audio channels to render, it is possible for the audio speaker to use the main channels when the signal is duplicated on the main and the ancillary channels. If all speakers use the same channels (for instance the main channels), then the others (for instance the ancillary channels) channels are not consumed. Thus the consumption of bandwidth is limited. This saving can notably permit to improve the efficiency of error recovering mechanisms and thus the robustness of the sound system.

Similarly, in such embodiments, the method can also comprise alerting 224 the audio rendering device about the sending of different audio signals on different pairs of audio channels. Depending upon embodiments, this alerting can be performed each time different audio signals are routed on audio channels, or only when an alert about the presence of duplicated audio channels has been performed previously (in other words when the alert relates to the end of a duplication). Sending an alert each time duplication of audio signal beings or ends can permit to be more adapted to communication system comprising audio rendering devices which presence (or powering up or down) vary upon the time.

The alerting 218, 224 about duplication, or end of duplication, can be performed on a Data Side Channel (DSC) integrated in the wireless paths between the master and the audio rendering devices and used for signalization messages.

Depending upon embodiments, the alerting can be performed periodically, when a presence and/or an absence of an incoming signal is detected, when the number of incoming signals is changed, and/or when a duplication of audio channels begins or ends. The alerting can be optional. Notably, the alerting can be omitted when the number of incoming signal does not change, even if the incoming signals changed (for instance if an analog source is replaced by a digital source).

In some embodiments, where the protocol used to transmit audio signals between the master device and an audio rendering device requires a pairing of both devices, the alerting can be performed conditionally. For instance, the alerting can be performed only after a given period of time (for instance 3, 5 or 7 minutes) has elapsed since the last pairing of the master device with an audio rendering device. Such an embodiment can permit to avoid disturbing the configuration of an audio rendering device by a change of the channels being selected and/or consumed by another audio rendering device.

It is to be noted that, according to the illustrated embodiment, after the alerting by the master, the choice of the channels to be consumed by an audio rendering device is let to the initiative of the audio rendering device. For instance, when being alerted of the duplication of the audio channels, a speaker can keep the audio channels that were already selected or change to the main channels for bandwidth saving.

Such an embodiment can be adapted to situations where the master has no knowledge of a capability of a speaker to dynamically select the audio channels to be consumed. Indeed, an audio speaker having no dynamical selection capability can just ignore the message.

In a variant, the master can send a request to the audio rendering device for changing the audio channels to be consumed. The request can notably comprise number of an audio channel to be consumed. Such an embodiment can be adapted to situation were the master has a knowledge of capabilities of dynamic selection of audio channels of the audio rendering devices, for instance when all audio rendering devices of the sound system have the same firmware.

In some embodiments, when a signal is duplicated on at least a first and a second audio channels, the audio channel to be consume, between the first and the second audio channel, can be selected (by the speaker and/or by the master) according to a selection rule. Such a selection rule can be the same for at least two speakers and/or for the master of a communication system. Notably, a selection rule can be based on the numbering of the audio channels.

For instance, when audio channels are numbered from 0 to n, the selected audio channel, beyond the channels conveying the duplicated audio signal, can be the channel having the smallest or the greatest number.

Figure 5:
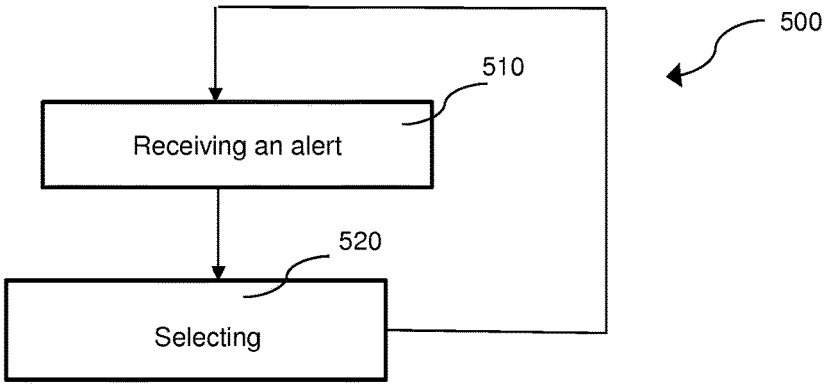
FIG. 5 illustrates an embodiment of the method of the present disclosure implemented in an audio rendering device of the sound system of FIG. 1.

FIG. 5 shows a particular embodiment of the method 500 of the present disclosure, implemented in an audio rendering device. For instance, the audio rendering device can be a speaker or a subwoofer illustrated by FIG. 1.

The method can comprise receiving 510 an alert about a duplication of at least a routed audio signal on said first and said second wireless audio channels and selecting 520 at least one audio channel to be consumed amongst said first and/or said second wireless audio channel according to said alerting.

Notably, when the routed audio signal is duplicated on said first and said second wireless audio channels, the method comprises; upon receiving said alert, consuming a single channel amongst said first and/or said second wireless audio channel.

In the illustrated embodiment, the method 500 permits to the audio rendering device to cooperate with a master device implementing the method 200 of the present disclosure. Thus, for concision purposed, exchanges that have been described in link with the method 200 are not detailed again in link with FIG. 5. (messages being transmitted by the master being received by the audio rendering device and vice versa).

The present disclosure has been described in relation with a master device having the capability of receiving at the same time two different incoming signals and outputting up to 4 audio channels. Of course, as it can be understandable for a person skilled in the art, the present disclosure may also be applied in a master device having different audio input and output capabilities. For instance, it can be applied to a master device that can receive up to three different audio inputs at the same time and that can output six audio channels. In such a case, each audio input can be routed to a couple of audio channels for instance.

As can be appreciated by one skilled in the art, aspects of the present principles can be embodied as a system, method, or computer readable medium. Accordingly, aspects of the present disclosure can take the form of a hardware embodiment, a software embodiment (including firmware, resident software, micro-code, and so forth), or an embodiment combining software and hardware aspects that can all generally be referred to herein as a "circuit", "module" or "system". Furthermore, aspects of the present principles can take the form of a computer readable storage medium. Any combination of one or more computer readable storage medium may be utilized.

A computer readable storage medium can take the form of a computer readable program product embodied in one or more computer readable medium and having computer readable program code embodied thereon that is executable by a computer. A computer readable storage medium as used herein is considered a non-transitory storage medium given the inherent capability to store the information therein as well as the inherent capability to provide retrieval of the information therefrom. A computer readable storage medium can be, for example, but is not limited to, an electronic, magnetic, optical, electromagnetic, infrared, or semiconductor system, apparatus, or device, or any suitable combination of the foregoing.

It is to be appreciated that the following, while providing more specific examples of computer readable storage media to which the present principles can be applied, is merely an illustrative and not exhaustive listing as is readily appreciated by one of ordinary skill in the art: a portable computer diskette, a hard disk, a read-only memory (ROM), an erasable programmable read-only memory (EPROM or Flash memory), a portable compact disc read-only memory (CD-ROM), an optical storage device, a magnetic storage device, or any suitable combination of the foregoing.

Thus, for example, it can be appreciated by those skilled in the art that the block diagrams presented herein represent conceptual views of illustrative system components and/or circuitry of some embodiments of the present principles. Similarly, it can be appreciated that any flow charts, flow diagrams, state transition diagrams, pseudo code, and the like represent various processes which may be substantially represented in computer readable storage media and so executed by a computer or processor, whether or not such computer or processor is explicitly shown.

The invention claimed is:

1. A distributed sound system belonging to a communication network and comprising:

at least one master device comprising at least one processor, a plurality of audio input interfaces and a plurality of wireless audio channels, and at least one wireless audio rendering device adapted to consume at least a first and a second of said audio channels, said at least one processor of said master device being configured for:

detecting at least one audio signal conveyed by at least one of said audio input interfaces;

routing said conveyed signal to at least one of said wireless audio channels, said routing taking into account a number of detected audio signals;

alerting said at least one wireless audio rendering device of said sound system when at least a part of said routed audio signal is duplicated on said first and said second wireless audio channels; and said at least one wireless audio rendering device comprising at least one processor configured for:

receiving an alert when said part of said routed audio signal is duplicated on said first and said second wireless audio channels;

upon receiving said alert, consuming a single channel amongst said first and/or said second wireless audio channel.

2. The distributed sound system of claim 1 wherein said single channel is selected according to a selection rule taking into account a numbering of said first and/or second audio channel.

3. The distributed sound system of claim 1 wherein said distributed sound system comprises at least two audio rendering devices and said single channel is selected according to a selection rule common to at least two of said audio rendering devices.

4. The distributed sound system of claim 1 wherein a bandwidth consumed by said distributed sound system when said at least one processor of said master device consumes said single channel is lower than a bandwidth consumed by said distributed sound system when said processor of said master device consumes said first and said second channel.

5. A master device adapted to be arranged in a distributed sound system belonging to a communication network, said master device comprising at least one processor, a plurality of audio input interfaces and a plurality of wireless audio channels, said at least one processor being configured for:

detecting at least one audio signal conveyed by at least one of said audio input interfaces;

routing said conveyed signal to at least one of said wireless audio channels, said routing taking into account a number of detected audio signals;

alerting at least one wireless audio rendering device of said sound system when at least a part of said routed audio signal is duplicated on at least a first and a second of said wireless audio channels.

6. The master device of claim 5, wherein said at least one processor is configured for sending said part of said routed audio signal conditionally on said first and/or said second channel.

7. The master device of claim 5, wherein said at least one processor is configured for receiving a selection of an audio channel, amongst said first and/or second audio channel, to be consumed by said audio rendering device.

8. The master device of claim 7, wherein said at least one processor is configured for sending said part of said routed audio signal conditionally on said first and/or said second channel according to said receiving.

9. The master device of claim 8, wherein said alerting comprises sending an alert on a Data Side Channel integrated in the wireless path between said master device and said audio rendering device.

10. The master device of claim 5, wherein said alerting is performed when the number of incoming signal is changed.

11. The master device of claim 5, wherein said alerting is performed conditionally according to a period of time elapsed since the last pairing of the master device with a wireless audio rendering device.

12. The master device of claim 5, wherein said processor is configured for alerting at least one wireless audio rendering device of said sound system about a routing of different audio signals on said first and second audio channels.

13. A method, adapted to be implemented in a master device of a distributed sound system, said master device comprising a plurality of audio input interfaces and a plurality of wireless audio channels, said method comprising:

detecting at least one audio signal conveyed by at least one of said audio input interfaces;

routing said conveyed signal to at least one of said wireless audio channels, said routing taking into account a number of detected audio signal;

alerting at least one wireless audio rendering device of said sound system when at least a part of said routed audio signal is duplicated on at least a first and a second of said wireless audio channels.

14. A non-transitory computer readable program product tangibly embodying a program of instructions executable by a computer for performing, when said non-transitory software program is executed by a computer, a method according to claim 13.

15. A method, adapted to be implemented in a wireless audio rendering device of a distributed sound system belonging to a communication network and comprising a master device, said audio rendering device being adapted to consume audio signals on a first and a second wireless audio channels, said method comprising:

receiving an alert about a duplication of at least a routed audio signal on said first and said second wireless audio channels;

selecting at least one audio channel to be consumed amongst said first and/or said second wireless audio channel according to said alerting.

16. A non-transitory computer readable program product tangibly embodying a program of instructions executable by a computer for performing, when said non-transitory software program is executed by a computer, a method according to claim 15.

17. A wireless audio rendering device of a distributed sound system belonging to a communication network, said distributed sound system comprising a master device, said audio rendering device being adapted to consume audio signals on at least a first and a second wireless audio channels, said audio rendering device comprising at least one processor configured for:

receiving an alert about a duplication of at least a routed audio signal on said first and said second wireless audio channels;

selecting at least one audio channel to be consumed amongst said first and/or said second wireless audio channel according to said alerting.

18. The wireless audio rendering device according to claim 17 wherein said at least one processor is configured for informing said master device about said selecting.

* * * * *